US009289109B2

(12) United States Patent
Forst et al.

(10) Patent No.: US 9,289,109 B2
(45) Date of Patent: Mar. 22, 2016

(54) DISHWASHER HAVING AN ADJUSTABLE UPPER BASKET

(75) Inventors: Klaus-Martin Forst, Gundelfingen (DE); Andreas Reiter, Finningen (DE); Jochen Riedinger, Dillingen (DE)

(73) Assignee: BSH Hausgeraete GmbH, Munich (DE)

( * ) Notice: Subject to any disclaimer, the term of this patent is extended or adjusted under 35 U.S.C. 154(b) by 971 days.

(21) Appl. No.: 13/400,142

(22) Filed: Feb. 20, 2012

(65) Prior Publication Data

US 2012/0222711 A1 Sep. 6, 2012

(30) Foreign Application Priority Data

Mar. 2, 2011 (DE) ..... 10 2011 004 951

(51) Int. Cl.
*A47L 15/18* (2006.01)
*A47L 15/50* (2006.01)

(52) U.S. Cl.
CPC ..... *A47L 15/503* (2013.01); *A47L 15/18* (2013.01); *A47L 15/504* (2013.01)

(58) Field of Classification Search
CPC . A47L 15/503; A47L 15/504; A47L 15/0092; A47L 15/50; A47L 15/4282; A47L 15/16
USPC ..... 211/41.8, 41.9
See application file for complete search history.

(56) References Cited

U.S. PATENT DOCUMENTS 3,486,804 A * 12/1969 Kauffman et al. ..... 312/228.1
5,944,037 A * 8/1999 Sinyong et al. ..... 134/176
2008/0156362 A1* 7/2008 Shin et al. ..... 134/201
2009/0038657 A1 2/2009 Kang
2009/0071508 A1* 3/2009 Sundaram et al. ..... 134/18
2010/0078048 A1* 4/2010 Schessl et al. ..... 134/115 R
2010/0314977 A1 12/2010 Mallory et al.
2012/0174951 A1* 7/2012 Burrows ..... A47L 15/508 134/25.2

FOREIGN PATENT DOCUMENTS

GB 2356555 A 5/2001
JP H0560463 U 8/1993
JP 2005118210 A 5/2005

OTHER PUBLICATIONS

European Search Report EP 12 15 5570 dated Apr. 29, 2013.

* cited by examiner

*Primary Examiner* — David Cormier
*Assistant Examiner* — Irina Graf
(74) *Attorney, Agent, or Firm* — James E. Howard; Andre Pallapies

(57) ABSTRACT

A dishwasher includes a washing container, and an upper basket located in an upper region of the washing container for accommodating items to be washed. The upper basket has a floor wall and a side wall that circumferentially bounds the floor wall and projects upward. The upper basket has a static first partial region and a second partial region that is movable relative to the first partial region between at least two positions, with the second partial region forming in the at least two positions at least one section of the floor wall. The section assumes different heights relative to a part of the floor wall of the first partial region in the at least two positions, wherein the section assumes for at least one of the at least two positions a height above a height of the part of the floor wall of the first partial region.

31 Claims, 3 Drawing Sheets

DISHWASHER HAVING AN ADJUSTABLE UPPER BASKET

BACKGROUND OF THE INVENTION

The invention relates to a dishwasher having an adjustable upper basket.

A dishwasher, in particular a domestic dishwasher, has a washing container which is as a rule cuboidal and has on its front side a door opening that can be closed by means of a front door. Position indicators such as "above", "below", or "at the front" refer to the operating position of the dishwasher when installed ready for operation. Located in the washing container's upper region is an upper basket and in its lower region as a rule a lower basket. Items to be washed, for example pots and pans, items of crockery, and cutlery, are put into the lower and upper basket. The maximum vertical clearance available for crockery in the lower basket is limited in terms of available height by the upper basket or, as the case may be, the floor wall on its base. A customary maximum size for a plate that can be placed vertically in a dishwasher is today about 33-35 cm. Problems arise when items that are taller or, as the case may be, larger, such as for, instance, baking trays, deep pots and pans, or oversized plates such as pizza or serving plates are to be washed. It is known how to lay such items flat across the lower basket. Space for other items requiring to be washed will then be wasted. It is alternatively known how to remove the upper basket in its entirety from the washing container, with said basket's then no longer being available for loading with additional items to be washed.

Known from DE 200 19 480 U1 is a dishwasher which instead of an upper basket has in the washing container's upper region for example two racks that can be folded against the washing container's wall. It is here possible, for example, to fold one rack down to provide a kind of upper basket on which items to be washed can be placed. The other rack can be folded up. The freed-up space in the washing container's upper region will then be available for particularly large items requiring to be washed which can be placed in the corresponding region of the lower basket.

Alternatively an upper basket for a dishwasher is known from US 2010/0314977 A1. A portion of the floor wall can be swiveled along with a portion of the side wall to create a gap in a partial region of the upper basket. Large items requiring to be washed that are located in the lower basket can then again project into the freed-up gap from below. The remainder of the upper basket will continue to be available for use by items requiring to be washed.

The aim of the present invention is to allow oversized items of crockery and/or household or, as the case may be, cooking utensils to be washed in a dishwasher simultaneously with the customary amount of daily crockery without having to accept a major limitation in the upper and lower basket's overall functionality.

BRIEF SUMMARY OF THE INVENTION

It is an object of the present invention to disclose an improved dishwasher.

The object is achieved by means of a dishwasher as claimed in claim 1. It has a washing container having an upper basket located in an upper region within it for accommodating items to be washed. The upper basket has an in particular approximately horizontal floor wall and an in particular approximately vertical side wall—or, as the case may be, one that delimits the crockery-basket floor—that circumferentially bounds it and projects or, as the case may be, protrudes upward. The floor wall is in particular the region of the crockery basket that is circumferentially bounded or, as the case may be, enclosed all around by its side wall. When the crockery basket's base is rectangular, its floor wall can be surrounded by the side wall preferably on four sides. So the side wall can have a plurality of wall parts. The upper basket's floor and side wall are therein, for example, metal or plastic mesh structures or, as the case may be, basket mats or plastic elements with holes. "Approximately horizontal" therein means that items requiring to be washed can be laid on the floor wall; a certain inclination, meaning tilting out of the horizontal plane, can be provided therein.

The upper basket has a static first partial region and a second partial region embodied as movable. The first partial region includes only part of the floor wall and all or part of the side wall. The second partial region can be moved between at least two positions relative to the first partial region. In all positions the second partial region forms at least one section of the upper basket's floor wall. For different positions the floor-wall section assigned to the second partial region therein assumes different heights relative to the height of the first partial region's part of the floor wall. For at least one position the section therein assumes a height above that of the first partial region's part of the floor wall. The different heights therein relate to the different height levels relative to a vertical.

The upper basket's second partial region is not a distinct component separate from the rest of the upper basket but instead forms an integral part of the upper basket and so belongs to it. The upper basket can therefore in other words be transformed between differently shaped variants in terms of its geometry or, as the case may be, the extent of its floor wall.

The upper basket's entire floor region is hence inventively embodied such that at least a part of it, specifically the section of the floor wall belonging to the second partial region, can be varied in terms of its height. The section will in at least one position be raised in height relative to the remainder of the floor wall. That will make space for larger items of crockery that are to be placed below, though with the floor wall being at least partially retained in that region also—above the large items of crockery. Above larger items of crockery requiring to be placed in position it will therefore nonetheless be possible to continue using the floor wall in the upper basket's second partial region for storing particularly flat items requiring to be washed, for instance items of cutlery.

Space will thereby inventively be made available for taller items requiring to be washed in the lower basket without having to remove the upper basket or parts thereof and without wasting storage space for flat items requiring to be washed above the particularly large items requiring to be washed.

The second partial region is held in a position by means of, for example, clips, hooks, or snap-on or clamping locking devices, or similar elements that can be assigned to the first or second partial region.

A concept of such kind disclosed for the upper basket can be used also for the lower basket in order here to create, for example, appliance space as is done similarly in the case of refrigerators and to match lower baskets to different heights of the washing container's floor. Thus for a series of dishwashers in which the design of the washing container's floor varies it will be possible to provide a single model of lower basket whose floor wall can be put into different positions. Although the space created by adjusting the lower basket cannot then be used for items requiring to be washed, it can be used for appliance components. The invention can furthermore in particular be combined with a segmented spray system that is known from, for example, EP 1 458 276 B1.

Other advantageous embodiments and developments of the invention are presented in the subclaims.

In a preferred embodiment variant of the invention, for at least one position the section assumes a height the same as that of the first partial region's floor wall. In other words, the entire floor wall will in that position then resemble that of a conventional, non-transformable upper basket. The floor wall will then, for example, be substantially level and extend across the entire available area between the side walls. The upper basket will then be adjustable between at least two positions, specifically the "normal" position just described—corresponding to a conventional upper basket—and at least one other position having an elevated section of the floor wall for taller items requiring to be washed in the lower basket.

In another embodiment variant of the invention, the section has for at least two positions an identical inclination relative to the horizontal. In other words, the section of the floor wall can only be height-adjusted between said two positions without therein being tilted or inclined. The section can hence in particular at both heights be used in the same way and will therein always extend, for example, horizontally for placing cutlery there. The section will therefore be, for example, in both positions horizontally oriented or is tilted, for instance, between 10° and 20° around a longitudinal or transverse axis of the dishwasher.

In another embodiment variant of the invention, the section in all positions will together with the first partial region's floor wall always cover the entire area circumferentially bounded by the side wall. In other words, no unusable gaps will hence be produced in the upper basket's floor wall regardless of the currently selected positions; instead, the upper basket's entire base area can be used by placing items to be washed on it. Also conceivable, though, is an alternative embodiment variant in which a part of the floor wall is omitted in at least one position. The section will then cover only a part of the area of the floor wall assigned to the second partial region. In other words, the upper basket will then in the second partial region contain an opening in the floor wall allowing items requiring to be washed that are located in the lower basket to project through the upper basket or, as the case may be, its floor wall. The washing container's maximum height can then be used in that region for items requiring to be washed that are located in the lower basket without being obstructed by the upper basket.

In a preferred embodiment variant of the invention, the second partial region essentially includes only the section of the floor wall. So the second partial region does not contain any partial region of the side wall. That belongs fully to the first section. So in that embodiment variant the second partial region will only be a height-adjustable section of the floor wall.

In another expedient embodiment variant, the second partial region contains a first and second wing. The first and/or second wing can be connected to the first partial region and/or to each other or else are connected in an articulating manner. In each position the first and/or second wing form(s) the section of the floor wall. For example in a first position the first wing forms a section of the floor wall and the second wing forms a section of the side wall. That is reversed in a second position, meaning the first wing will form a section of the side wall and the second wing will form a section of the floor wall. The second partial region will thus have a double function in each of the two positions. Specifically it will form a part of the floor wall and part of the side wall, the result of which is particularly good material utilization in the upper basket.

In another preferred embodiment variant of the invention, the second partial region is located in a side region of the upper basket. The upper basket can as a rule be pulled out of the washing container toward the front of the dishwasher, meaning through the door opening. The cited side region will then be the upper basket's left-hand or right-hand edge region, so one which borders a left-hand or right-hand pull-out rail. Thus even when tall items to be washed are placed in the lower basket it will be possible to push in and pull out both it and the upper basket with no disruptive intervention from the items to be washed. The partial region can, though, alternately also be located for example on the front or rear of the upper basket or in a central region.

In another embodiment variant a spraying device, in particular a rotatable spray arm or an upper-basket spray, is assigned to the upper basket in the dishwasher. Said device applies washing fluid to the upper basket. The spraying device such as, for example, an upper-basket spray can inventively be displaced toward or away from the second partial region, thus in particular in a lateral direction parallel to the door opening. If, for example, the section has in one position been lowered to the height of the remaining floor wall, the spraying device such as, for example, an upper-basket spray will be displaced toward the second partial region and hence cover essentially the entire upper-basket region centrally. If the upper basket has been transformed such the section is repositioned upward and only flat items requiring to be washed are on it, the spraying device such as, for example, an upper-basket spray can be displaced away from the second partial region and hence centrally wash the rest of the region of the upper basket's floor in the first partial region.

Except, for example, in cases of clear dependencies or incompatible alternatives, the advantageous embodiments and developments of the invention that were explained above and/or are presented in the subclaims can therein be applied individually or in any mutual combination in the inventive dishwasher.

BRIEF DESCRIPTION OF THE DRAWINGS

The invention and its advantageous embodiments and developments as well as the advantages thereof are explained in more detail below with the aid of drawings that are basic schematic sketches.

DETAILED DESCRIPTION OF EXEMPLARY EMBODIMENTS OF THE PRESENT INVENTION

Figure 1:
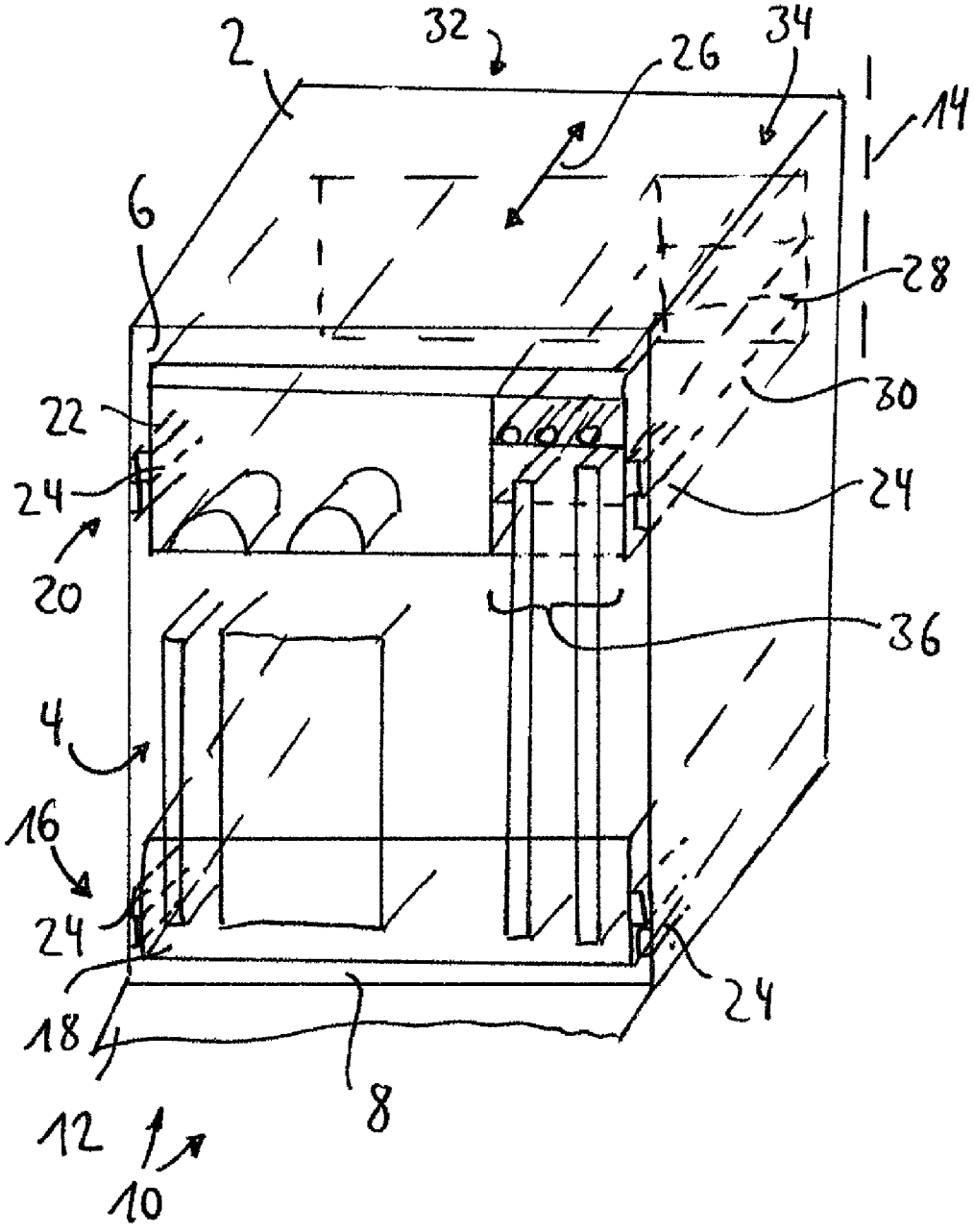
FIG. 1 is a perspective representation of a dishwasher having an inventively embodied upper basket.

FIG. 1 shows a dishwasher 2 in a view onto its front side 4. Located there is a door opening 6 for enabling washing container 8 forming the interior space of dishwasher 2 to be loaded with items 10 requiring to be washed. A door 12 which during operation closes door opening 6 is therefore indicated in a folded open position. Dishwasher 2 has been installed ready for operation, meaning its side walls are aligned with a vertical 14. Located in a lower region 16 of washing container 8 is a lower basket 18 and in an upper region 20 of washing container 8 is an upper basket 22. Upper basket 22 and lower basket 18 are retained on washing container 8 with the aid of guide rails 24 or other retaining/pull-out devices and can be pulled out in the direction of arrow 26 toward door opening 6, meaning in the dishwasher's longitudinal direction toward its front side 4. Upper basket 22 includes an approximately vertical side wall 28 which circumferentially bounds an approximately horizontal floor wall 30. Items 10 requiring to be washed have been placed both in lower basket 18 and in upper basket 22.

Upper basket 22 has a static first partial region 32 and a second partial region 34 that can be moved relative to first partial region 32. In the exemplary embodiment the second partial region 34 forms—as viewed from the front onto door opening 6 in the top view shown—a right-hand side region 36 of upper basket 22. So it faces right-hand guide rail 24. Second partial region 34 could, though, in an embodiment variant that is not shown also be located on the opposite, left-hand side region.

Figure 2:
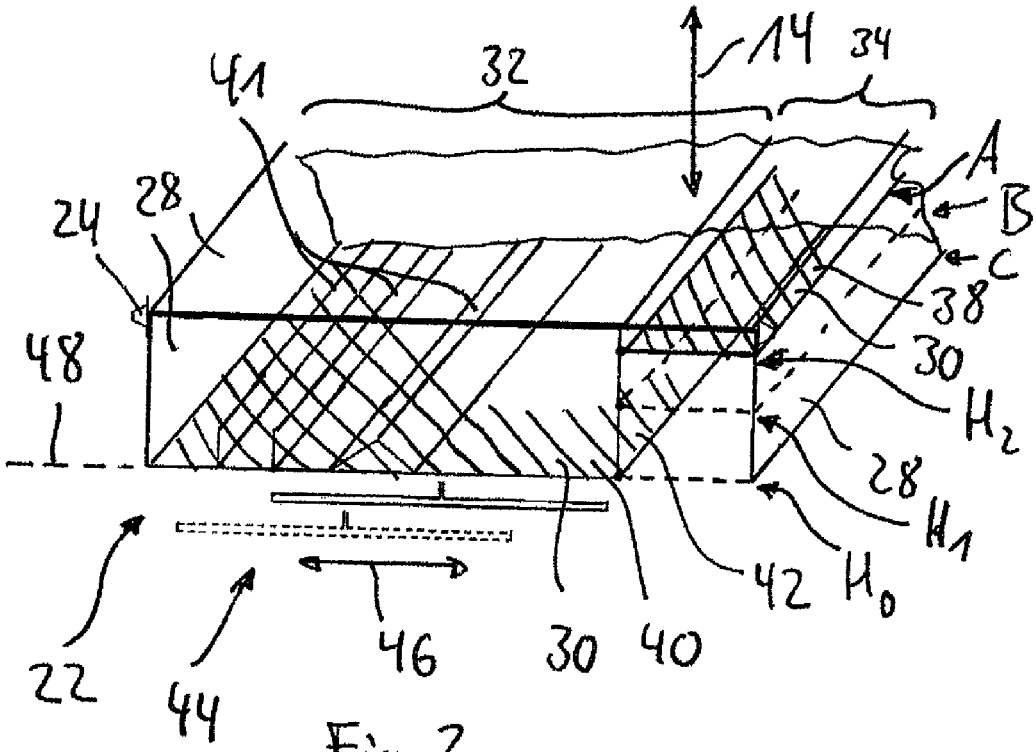
FIG. 2 shows the upper basket shown in FIG. 1 in detail.

FIG. 2 shows upper basket 22 in detail. Second partial region 34 contains in the embodiment variant shown only a section 38 of floor wall 30 but no part of side wall 28. That belongs solely to first partial region 32. First partial region 32 includes remaining part 40 of floor wall 30 as well as all side walls 28 and a likewise vertical partition 42. It delimits part 40 of floor wall toward second partial region 34. Floor wall 30 contains support structures 41 to simplify or, as the case may be, improve the storing of items 10 requiring to be washed.

Floor wall 30 embodied as being in two parts is shown hatched in FIG. 2. Its section 38 is embodied as capable of moving relative to remaining part 40 or, as the case may be, the remainder of upper basket 22, which is to say first partial region 32. The ability to move consists here in a height-adjustability in the direction of vertical 14. FIG. 2 shows second partial region 34 pulled out in a first position A. Hooks or snap-in, snap-on, or clamping connections and suchlike (not shown) are used to lock second partial region 34 or, as the case may be, section 38 of floor wall 30 into or, as the case may be on first partial region 32, in particular of side wall 28 and partition 42, or, as the case may be, to change between positions A-C. Section 38 can therefore be easily changed over by an operator (not shown) between positions A-C.

Section 38 has in position A a height $H_2$ that is above a height $H_0$ of remaining part 40 of floor wall 30. Heights $H_{0,2}$ relate to different positions in the direction of vertical 14.

As can be seen from FIG. 1, positioning section 38 at height $H_2$ in upper region 20, meaning in the region of upper basket 22, will make room for especially tall items 10 requiring to be washed that have been placed in lower basket 18. Section 38 can, though, continue being used for storing further items 10 requiring to be washed, for example flat cutlery, on section 38 above taller items 10 requiring to be washed. The space above especially tall items 10 requiring to be washed can thus continue being used for items 10 requiring to be washed.

Second partial region 34 in the form of section 38 can be moved (indicated in FIG. 2 by dashing) along arrow 14 also into positions B or C or, as the case may be, heights $H_1$ or $H_0$. Although less vertical clearance will then be available in dishwasher 2 for items 10 requiring to be washed in lower basket 18, that is compensated by the availability of more vertical clearance for items 10 requiring to be washed that are to be placed on section 38. There will be an almost level total floor wall 30 particularly in position C because the height $H_0$ of section 38 and of remaining part 40 will be the same. Partition 42 will in that position then be removable for example also in an alternative embodiment variant. The result will be an upper basket 22 having approximately the same amount of floor storage area for crockery as a conventional upper basket.

Also indicated in FIG. 2 is an upper-basket spray or rotatably mounted spray arm as an exemplary spraying device 44 which is assigned to upper basket 22 for applying washing fluid (not shown) thereto. Spraying device 44 is coupled preferably on the underside of static first partial region 32 of floor wall 30. To enable the washing result to be optimally matched to respectively selected position A-C of second partial region 34, spraying device 44 can be displaced in the direction of arrow 46, meaning in the transverse direction of dishwasher 2 to the left or right, which is to say away from or toward second partial region 34. It can be ensured thereby that the spraying device can be oriented in keeping with the static first partial region 32, in particular, for example, toward its center, if the second, movable partial region 34 has been taken to a height having a vertical clearance from first partial region 32.

According to the exemplary embodiment shown in FIG. 2, second partial region 34 in the form of section 38 of floor wall 30 can be height-adjusted such that section 38 will in each of positions A-C assume the same inclination relative to an area or, as the case may be, horizontal 48, in this case will always be parallel thereto. Section 38 can in alternative embodiment variants also always assume the same inclination relative to the horizontal in all positions A-C. It is, though, alternatively also conceivable for section 38 to assume different inclinations relative to horizontal 48 in different positions A-C.

In the exemplary embodiment according to FIGS. 1 and 2, in each of positions A-C the entire floor wall 30, meaning section 38 and remaining part 40 together, covers the entire base area—circumferentially bounded by side wall 28—of upper basket 22.

Figure 3:
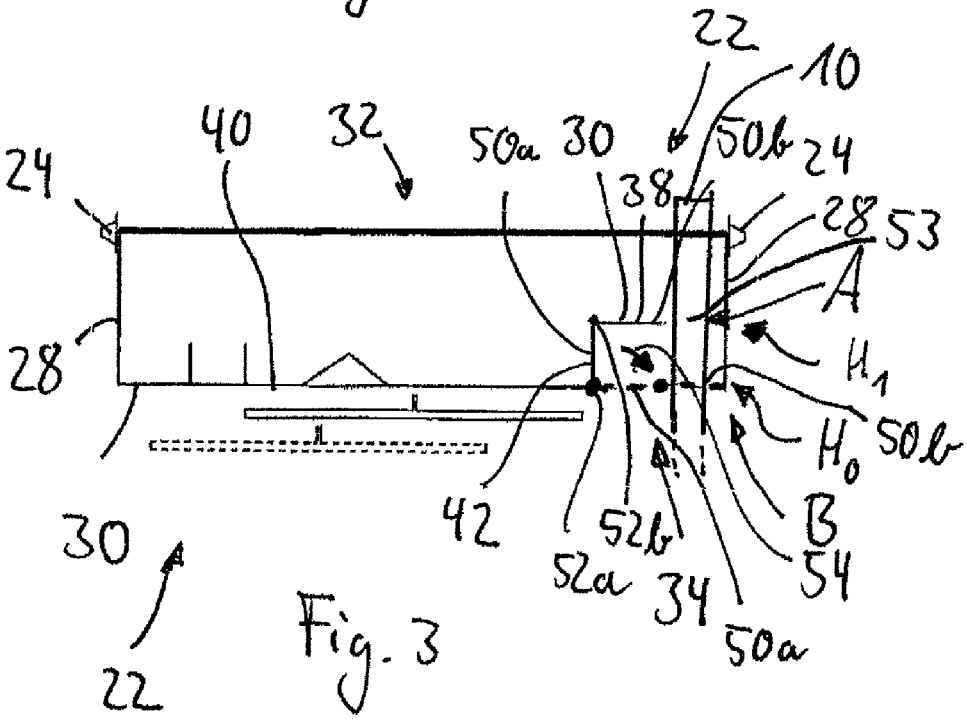
FIG. 3 is a front view of an alternative upper basket.

FIG. 3 is a top view of an alternative embodiment variant of an upper basket 22 from front side 4. Second partial region 34 here includes a first wing 50*a* which is attached via a swivel joint 52*a* to floor wall 30 of first partial region 32 or, as the case may be, part 40 of said wall. Second partial region 34 furthermore includes a second wing 50*b* which is in turn mounted via a second swivel joint 52*b* on first wing 50*a*. In position A shown in FIG. 2, first wing 50*a* forms a partition 42 and second wing 50*b* forms a section 38 of floor wall 30 at a height $H_1$. The entire floor wall 30, which is to say section 38 together with remaining part 40, now in contrast to what is described above no longer covers the entire base area—delimited by side wall 28—of upper basket 22. Instead, a gap 53 allowing items 10 requiring to be washed to fully project through upper basket 22 is left in second partial region 34 in upper basket 22.

Swiveling the two wings 50*a, b* in the direction of arrow 54 will take them to position B, drawn with a dashed line in FIG. 3. Both wings 50*a, b* will then together form section 38 of floor wall 30, which is at the same height $H_0$ as remaining part 40 of floor wall 30. Floor wall 30 will now in turn completely fill the entire space between the wall parts of side wall 28. Items 10 requiring to be washed can again be placed on section 38 of floor wall 30 in both positions A and B (not shown).

Figure 4:
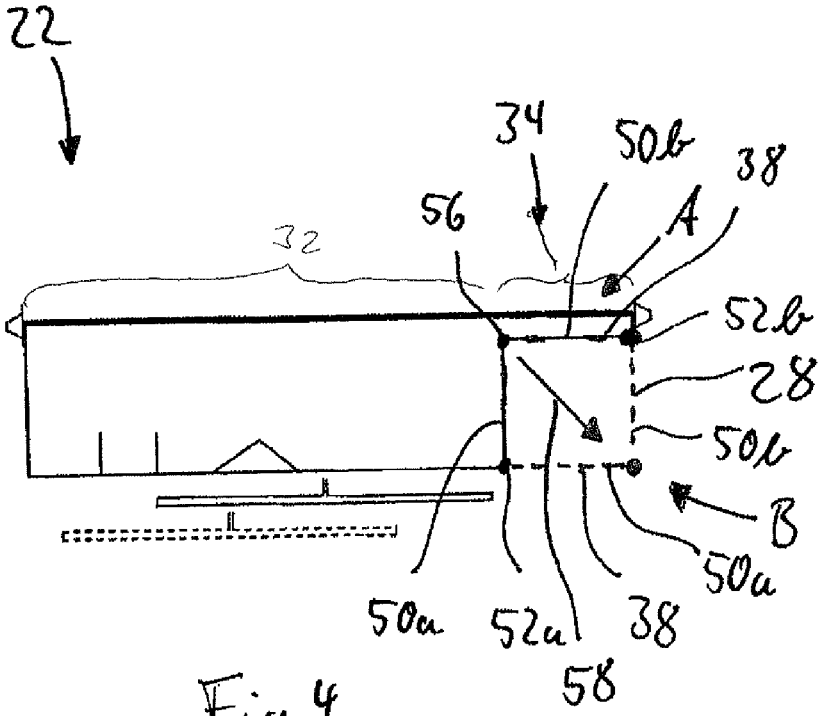
FIG. 4 is a front view of an alternative upper basket.

FIG. 4 shows another alternative embodiment variant of an upper basket 22. Analogously to FIG. 3, here, too, the second partial region has two wings 50*a, b* which, though, are connected to first partial region 32 via a respective swivel joint 52*a, b*. Wings 50*a, b* are connected to each other via, for example, an elongated-hole guide 56. FIG. 4 shows, pulled out, a position A in which wing 50*b* forms a section 38 of floor wall 30 and wing 50*a* forms a partition 42. Swiveling the two wings 50*a, b* in the direction of arrow 58 will take second partial region 34 to position B. The ends—situated respectively opposite swiveled joints 52*a, b*—of wings 50*a, b* are guided during the swiveling action via elongated-hole guide 56 that is shown. Wings 50*a, b* change roles in position B: Wing 50*a* forms section 38 while wing 50*b*, by contrast, does not form a partition but a part of side wall 28. Wings 50*a, b* therefore both perform a double function in both positions A, B. In particular, second partial region 34 here includes not only a part of floor wall 30 but also a part of side wall 28. Partition 42 is therefore in position A at the same time also a side wall 28. A joint or suchlike may also be expedient instead of the elongated-hole guide.

Wings 50*a, b* are in an alternative embodiment variant not connected permanently via an elongated-hole guide 56 but can instead only be connected in positions A and B. For swiveling between positions A and B, relevant clips, catches, or similar are released and wings 50*a, b* are swiveled in the direction of arrow 58 and latched together again in position B.

What is claimed is:

1. A dishwasher, comprising:

a washing container;

an upper basket located in an upper region of the washing container for accommodating items to be washed, said upper basket having a floor wall and a side wall that circumferentially bounds the floor wall and projects upward, said upper basket having a) a vertically stationary first partial region and b) a second partial region that is movable relative to the first partial region between at least two positions, said second partial region comprising a second floor wall section that is movable between the at least two positions, the at least two positions corresponding to different heights relative to a first floor wall section of the first partial region, wherein the second floor wall section assumes for at least one of the at least two positions a height above a height of the first floor wall section; and a spraying device connected to the upper basket and configured to apply washing fluid to the upper basket, the spraying device being transversely displaceable in a first direction away from a second partial region side of the upper basket and toward a first partial region side of the upper basket, the spraying device being transversely displaceable in a second direction away from the first partial region side of the upper basket and toward the second partial region side of the upper basket, the displacement of the spraying device in the first and second directions being connected to the movement of the second partial region between the different heights.

2. The dishwasher of claim 1, wherein the floor wall is approximately horizontal.

3. The dishwasher of claim 1, wherein the side wall is approximately vertical.

4. The dishwasher of claim 1, wherein the second partial region is movable in relation to the first partial region to a position in which the second floor wall section assumes a height which is the same as the height of the first floor wall section.

5. The dishwasher of claim 1, wherein the second floor wall section has an identical inclination relative to a horizontal in the at least two positions.

6. The dishwasher of claim 1, wherein the second floor wall section together with the first floor wall section covers in the at least two positions an entire area circumferentially bounded by the side wall.

7. The dishwasher of claim 1, wherein the second partial region substantially includes only the second floor wall section.

8. The dishwasher of claim 1, wherein the second partial region includes first and second wings which are connectable at least in one of two ways, a first way in which the first and second wings are connected to the first partial region, a second way in which the first and second wings are connected to each other, with at least one of the first and second wings forming the second floor wall section in each of the positions.

9. The dishwasher of claim 1, wherein the second partial region is located in a side region of the upper basket.

10. The dishwasher of claim 1 further comprising a lower basket below the upper basket.

11. The dishwasher of claim 1, wherein the upper basket is movable as a unit.

12. The dishwasher of claim 1, wherein the displacement of the spraying device is linear.

13. The dishwasher of claim 1, wherein the spraying device is configured to a) be centered on the first floor wall section of the first partial region when the second floor wall section is above the first floor wall section and b) be centered on the combined first floor wall section and second floor wall section when the first floor wall section and the second floor wall section are at the same height.

14. A dishwasher, comprising:

a washing container; and an upper basket located in an upper region of the washing container, the upper basket being configured to accommodate items to be washed and comprising an adjustable floor wall configured to support the items to be washed; and a spraying device connected to the upper basket and configured to apply washing fluid to the upper basket, wherein a first portion of the floor wall is vertically stationary and a second portion of the floor wall is vertically movable and settable between an uppermost position and a lowermost position, and wherein the spraying device is translatable in a first direction away from the second portion of the floor wall, the translation of the spraying device in the first and second directions being connected to the vertical movement of the second portion of the floor wall with respect to the first portion of the floor wall.

15. The dishwasher of claim 14, wherein the floor wall is substantially horizontal.

16. The dishwasher of claim 14, wherein a substantially vertical side wall extends upward from the floor wall.

17. The dishwasher of claim 14, wherein the second portion of the floor wall is configured to have the same inclination relative to horizontal at different vertically settable positions.

18. The dishwasher of claim 17, wherein the second portion is configured to be clipped to the upper basket at a plurality of positions.

19. The dishwasher of claim 18, wherein the plurality of positions correspond to a plurality of heights above the first portion of the floor wall.

20. The dishwasher of claim 14 further comprising a lower basket below the upper basket.

21. The dishwasher of claim 14, wherein the translation of the spraying device is linear.

22. The dishwasher of claim 14, wherein the upper basket is movable as a unit.

23. The dishwasher of claim 14, wherein the spray device is configured to a) be centered on the first portion of the floor wall when the second portion of the floor wall is above the first portion of the floor wall and b) be centered on the combined first portion of the floor wall and the second portion of the floor wall when the first portion of the floor wall and second portion of the floor wall are at the same height.

24. A dishwasher, comprising:

a washing container;

a lower basket located in a lower region of the washing container;

an upper basket located in an upper region of the washing container above the lower basket, the upper basket being configured to accommodate items to be washed and comprising a floor wall configured to support the items to be washed; and a spraying device connected to the upper basket, wherein a first partial region of the upper basket is vertically immovable relative to the washing container, wherein a second partial region of the upper basket is vertically movable relative to the washing container, wherein the first partial region includes a first portion of the floor wall and the second partial region includes a second portion of the floor wall, and wherein the spraying device is movable within the washing container and is movable in a first direction away from the second partial region and in a second direction toward the second partial region, the movement of the spraying device in the first and second directions being connected to the vertical movement of the second partial region relative to the first partial region.

25. The dishwasher of claim 24, wherein the second portion of the floor wall is pivotably attached to the first portion of the floor wall.

26. The dishwasher of claim 25, wherein the second portion of the floor wall comprises a first pivotable portion and a second pivotable portion, the first and second pivotable portions being hingedly attached to each other.

27. The dishwasher of claim 26, wherein the first pivotable portion is configured to form the second portion of the floor wall when the second pivotable portion is substantially vertical.

28. The dishwasher of claim 27, wherein the second pivotable portion is configured to form the second portion of the floor wall when the first pivotable portion is substantially vertical.

29. The dishwasher of claim 24, wherein the movement of the spraying device is linear.

30. The dishwasher of claim 24, wherein the upper basket is movable as a unit.

31. The dishwasher of claim 24, wherein the spraying device is configured to a) be centered on the first partial region when the second partial region is above the first partial region and b) be centered on the combined first partial region and second partial region when the first partial region and the second partial region are at the same height.

* * * * *